US008434638B2

(12) United States Patent
McKenzie

(10) Patent No.: US 8,434,638 B2
(45) Date of Patent: May 7, 2013

(54) FRACTURE TANK

(75) Inventor: Michael P. McKenzie, New Waterford, OH (US)

(73) Assignee: Alpha Tanks, LLC, Youngstown, OH (US)

( * ) Notice: Subject to any disclaimer, the term of this patent is extended or adjusted under 35 U.S.C. 154(b) by 540 days.

(21) Appl. No.: 12/316,245

(22) Filed: Dec. 11, 2008

(65) Prior Publication Data

US 2010/0147860 A1 Jun. 17, 2010

(51) Int. Cl.
*B65D 8/04* (2006.01)

(52) U.S. Cl.
USPC ..... 220/626; 220/562; 220/1.5; 280/837

(58) Field of Classification Search ..... 220/628, 220/646, 650, 626, 1.5, 647, 4.12, 571, 562, 220/573, 836; 280/837, 831, 839
See application file for complete search history.

(56) References Cited

U.S. PATENT DOCUMENTS 3,685,458 A * 8/1972 Price et al. ..... 105/358
3,918,736 A * 11/1975 Hickman ..... 280/676
4,318,549 A * 3/1982 Pletcher ..... 280/837
4,603,733 A * 8/1986 Loevinger ..... 165/41
4,819,955 A * 4/1989 Cobb ..... 280/837
4,948,519 A * 8/1990 Zeh ..... 220/4.12
5,232,246 A * 8/1993 Page ..... 280/837
6,152,492 A * 11/2000 Markham et al. ..... 280/837
6,173,991 B1 * 1/2001 Piona et al. ..... 280/837

* cited by examiner

*Primary Examiner* — Andrew Perreault
(74) *Attorney, Agent, or Firm* — Renner Kenner Greive Bobak Taylor & Weber

(57) ABSTRACT

A fracture tank for use in oil fields and the like that is readily adaptable for manipulation in hilly and muddy terrain by being pushed by a bulldozer or similar piece of equipment. The undercarriage of the fracture tank is encased tapered skid plates to enhance the support area, while accommodating the movement of muddy or loose soil therethrough, while the fracture tank is slid over the terrain. The formation of skid plates preclude the compacting of mud and dirt within the undercarriage as in the prior art. The fracture tank is further provided with a strengthened rear bumper assembly and wheel spring hangers to allow for forceful movement when the rear wheels of the tank are frozen or compacted with dirt and mud to a point that they are substantially immovable. The fracture tank is further provided with a purging system consisting of an inlet spray tubing and an outlet drainage. Additionally, tubing is provided for conveying heated gas within the interior of the tank and venting the same out of the top. The fracture tank further includes bumpers for the allowing ganging of tanks, and mesh-like pads atop the tanks for safe maneuvering of workers thereon.

14 Claims, 5 Drawing Sheets

FRACTURE TANK

FIELD OF THE INVENTION

The present invention generally relates to fracture tanks that store fluid to be injected into a well bore to fracture the formation around the bore. More particularly, the present invention relates to a fracture tank bearing one or more improvements in order to facilitate the use of the tank. Specifically, the present invention relates to fracture tanks having one or more improvements relating to the structural integrity of the tank or the manner in which the tank may be used or serviced.

BACKGROUND OF THE INVENTION

Hydraulic fracturing is now a commonly used method for creating fractures that extend from a bore hole into the surrounding rock formations. This method may also be informally referred to as "fracing" or "hydrofrac." Although hydraulic fracturing is perhaps most commonly employed to stimulate production from oil and gas wells, it is also applied in stimulating ground water wells, preconditioning rock for caving or inducing rock to cave in mining, as a means of enhancing waste remedial processes, to dispose of waste by injection into suitable deep rock formations, and as a method to measure the stress in the Earth.

In accordance with hydraulic fracturing processes, multiple fracture tanks are transported to a bore hole site with these fracture tanks storing the fluid that is to be employed in the hydraulic fracturing method. The fluid held in the fracture tanks is injected into the bore hole at a rate and pressure sufficient for creating or restoring fractures in the surrounding formation, thereby increasing the surface area of the formation that is exposed to the bore hole. The fractures provide a path along which fluids or gases may flow either from the formation into the bore hole (in the case of extracting fluids or gases) or from the bore hole into the surrounding formation (in the case of injecting fluid or gas into a formation). With respect to oil recovery, the fractures serve to increase the rate at which oil can flow from the surrounding formation into the bore hole for extraction.

In a given hydraulic fracturing operation, multiple fracture tanks will be required inasmuch as each tank can only hold a limited amount of fracturing fluid. The fracture tanks employed in the art are simply storage trailers that are transported to the site by a tractor truck. That is, the typical fracture tank is a trailer portion of a tractor-trailer combination. When the bore hole is located at a site having flat terrain, it is usually sufficient to simply drive the tractor-trailer combination to the desired location in the area surrounding the bore hole such that the fracture tank can be accessed and used when necessary. However, when the area surrounding the bore hole is hilly or otherwise not sufficiently flat, the tractor may be unable to transport the fracture tank (i.e., trailer) to the desired location. Similarly, if the terrain surrounding the bore hole is moist, the tractor-trailer combination often times becomes stuck. Thus, the fracture tanks can usually only be transported around a bore hole site if that site is flat and well drained, and, in hilly regions or moist/muddy soil, it has been found necessary to transport the fracturing tanks by pushing them with bulldozers.

Notably, fracture tanks of the prior art are not specifically given to being pushed around by bulldozers. Thus, a number of problems are encountered. For example, the undercarriages of the fracture tanks have transverse strengthening ribs or joists, and mud can collect between these ribs such that the fracture tank becomes bogged down and is difficult to maneuver, even with the bulldozer. Additionally, after the fracture tank is removed from the site, mud clumps can fall out from the undercarriage during road transport, and this can be dangerous for other vehicles on the road. Thus, the fracture tanks may need to be cleaned and otherwise maintenanced, increasing the costs in using such tanks.

Because the fracture tanks are not constructed for being manipulated by a bulldozer, the tanks can often become damaged by the bulldozer, again increasing the costs. The fracture tanks can become stuck in the mud in moist terrain, and the bulldozer, which is sufficiently powerful enough to move the fracture tank, can damage portions of the tank by forcing against the resistance of the mud. This is specifically true when a tank has been allowed to sit for some time, permitting the mud to dry around portions of the tank. For example, the rear wheels and spring hangers on which they are mounted can sometimes become encased in dried mud and a bulldozer pushing on the fracture tank can cause the wheels, spring hangers, or even the support beams to which they are mounted to become twisted or otherwise structurally compromised.

Water is one of the most common fracturing fluids employed in hydraulic fracturing, and, when it is employed can sometimes be drawn from local lakes and streams and the like. Thus, it is not uncommon for the fracture tanks hold not only water but algae, water plants and other debris. This debris tends to clog the outlet port of the fracture tank and must therefore be periodically removed. In the prior art, the fracture tanks have simply been cleaned by workers entering the tanks and physically removing the algae, plant matter, debris, etc.

In cold climates, the fluid held in a fracture tank may freeze, and this may result in damage to the fracture tank and/or render the tank useless for operation.

Further, because moving items by bulldozer is not a precise way to position items, it is common for one fracture tank to be pushed forcefully into another in an attempt to align the multiple fracture tanks at a desired location near the bore hole. Additionally, it is often necessary for workers to climb atop a fracture tank and safely walk from one to another, in areas where mud, rain and snow may make such walking dangerous.

Thus, there is a need in the art for a fracture tank that is easy to. manipulate in hilly and muddy terrain, that has ready means for heating, cleaning and flushing, that is easily ganged with other fracture tanks, and that is safe to walk upon, and from one to another.

SUMMARY OF THE INVENTION

In light of the foregoing, it is a first aspect of the invention to provide a fracture tank that is easy to manipulate in hilly and muddy terrain.

Another aspect of the invention is the provision a fracture tank that includes means for cleaning and flushing of the interior of the tank, to remove unwanted debris and material therefrom.

Yet another aspect of the invention is the provision of a fracture tank that includes means for heating the interior thereof, to prevent freezing of the fracture water contained therein.

Still a further aspect of the invention is the provision of a fracture tank that has a strengthened rear bumper system to accommodate engagement by a bulldozer blade for movement within a hilly or muddy terrain.

Still another aspect of the invention is the provision of a fracture tank in which the undercarriage thereof is provided with skid plates encasing the undercarriage structure and providing means for facilitating movement thereof in various environments.

Yet a further aspect of the invention is the provision of a fracture tank that may be easily ganged with other fracture tanks, that is safe to walk upon, and that accommodates ready movement of workers from one ganged tank to another.

The foregoing and other aspects of the invention that will become apparent as the detailed description proceeds are achieved by a fracture tank, comprising an undercarriage, said undercarriage comprising a load floor having a right side and a left side defining a width of the load floor, and a front and rear defining a length of said load floor, a right frame member extending along the length of said load floor to provide structural support for the undercarriage, a left frame member extending along the length of said load floor to provide structural support for the undercarriage, a right skid plate extending from said right frame member along at least a portion of the width of the load floor, a left skid plate extending from said left frame member along at least a portion of the width of the load floor, said right and left skid plates providing a flat surface for supporting the tank as it is pushed over a ground surface while resting on said right and left skid plates.

Yet other aspects of the invention that will become apparent herein are obtained by a fracture tank for oil field use, comprising an undercarriage having a pair of oppositely disposed skid plates therealong, said skid plates boxing joists of said undercarriage, a tank atop said undercarriage, said tank defined by pairs of opposed sides, ends, and a roof and floor, at least one heat pipe entering said tank at a first region thereof, and exiting said tank at a second region thereof, and a flush system comprising a perforated flush pipe extending about at least a portion of an interior of said tank, and a drain exiting said tank near said floor.

DETAILED DESCRIPTION OF ILLUSTRATIVE EMBODIMENTS

Figure 1:
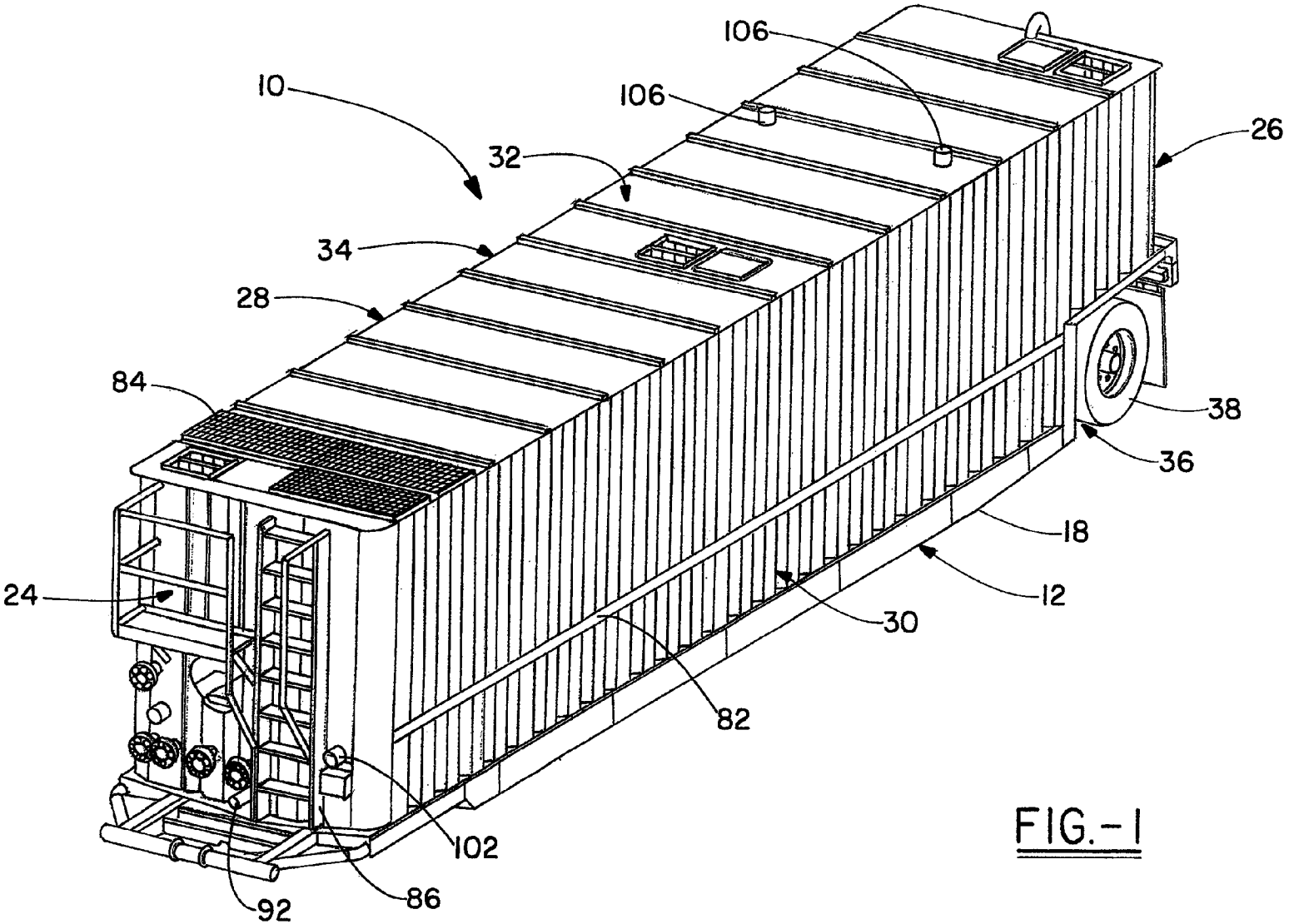
FIG. 1 is a perspective view of a fracture tank in accordance with the invention, shown removed from a common tractor.
Figure 2:
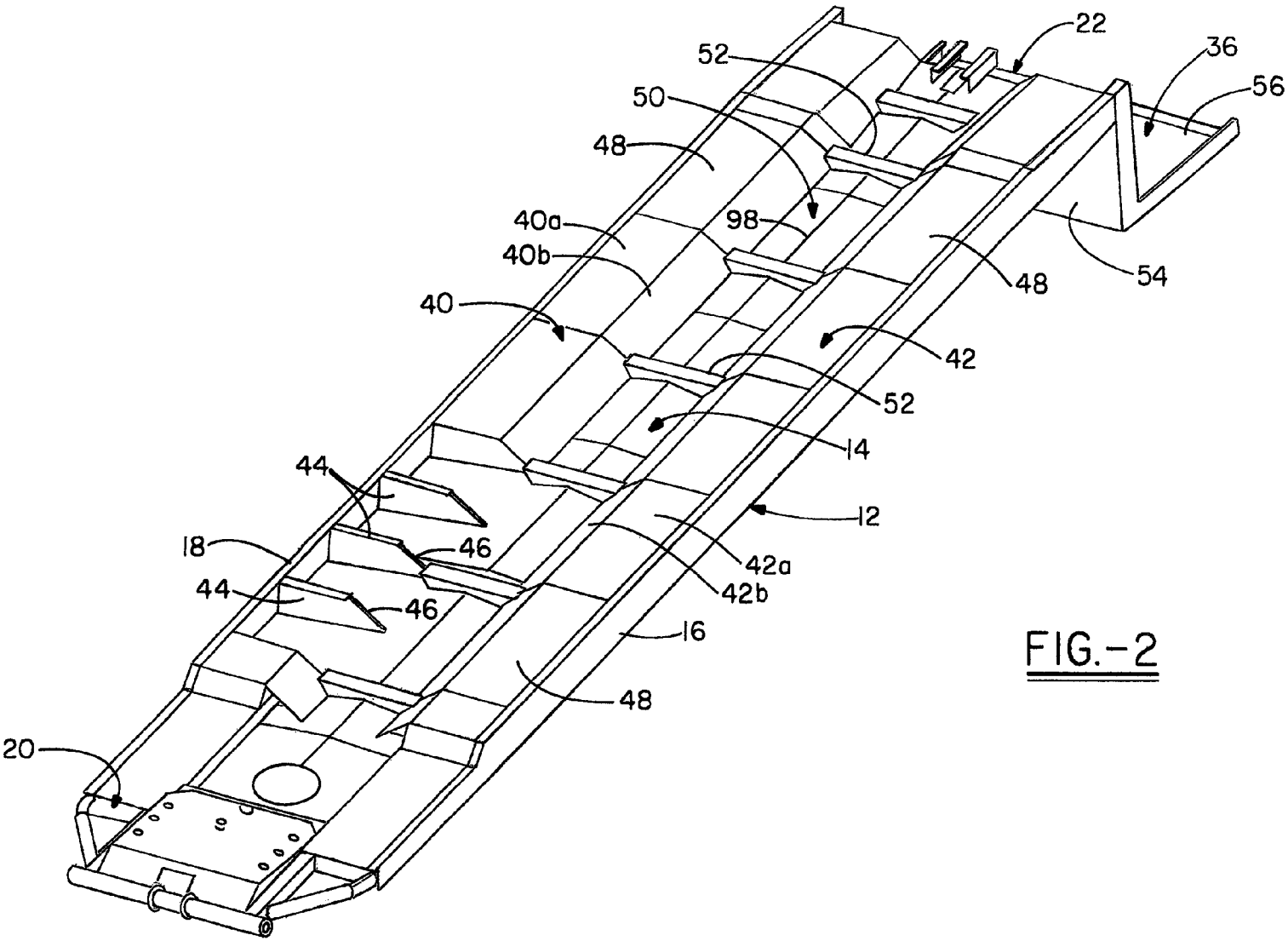
FIG. 2 is a perspective view of the underside of the undercarriage of the fracture tank, shown with a portion of a left skid plate removed to show split joists.

Referring now to FIG. 1, a fracture tank in accordance with this invention is shown and designated by the numeral 10. The fracture tank 10 includes an undercarriage 12, which serves as the bottom support structure of the fracture tank 10. As seen in FIG. 2, the undercarriage 12 includes a load floor 14 having a right hand side bounded by a right frame member or beam 16, and a left hand side bounded by a left frame member or beam 18. The right and left frame members 16, 18 extend along the length of the load floor 14 from the front 20 to the rear 22 thereof. Referring back to FIG. 1, a front wall 24, a rear wall 26, a right sidewall 28, and a left sidewall 30 extend upwardly from the load floor 14, and are capped with a top wall or roof 32 to define a storage tank 34, which is the interior volume defined by the load floor and all of the walls. Notably, with reference to FIG. 3, it can be seen that the load floor 14, in this particular embodiment, is discontinuous, inasmuch as it jogs upwardly at a wheel box 36, which will be described more particularly below. However, the rear wall 26 is still considered as extending upwardly from the load floor, and this should be particularly appreciated in light of the fact that it could be possible to create a fracture tank without a wheel box, instead having the wheels mounted directly under a continuous load floor, i.e., when the storage tank is symmetrically rectangular. Notably, the right sidewall 28 and the left sidewall 30 also step upwardly at the wheel box 36.

It will be appreciated that fracture tanks are typically pulled to a desired location at a bore hole by being towed by a tractor, when the ground is well drained and relatively flat. However, when the ground is moist or hilly or both, fracture tanks are typically moved to a desired location by being pushed by a bulldozer. Thus, in hilly and/or moist regions, a fracture tank is disconnected from the tractor and is pushed around in a form as generally seen in FIG. 1, with the fracture tank resting on the ground on its undercarriage and on the rear wheels 38. As previously mentioned, pushing a fracture tank of the prior art along the ground surface would typically cause a significant amount of mud, dirt and other debris to collect on the exterior surface of the undercarriage. Such mud, dirt and debris greatly impedes the ability to move the tank and the collected matter is susceptible to falling off of the undercarriage during road transport of the fracture tank. Particularly, those of skill in the art will recognize that joists typically extend crosswise between the right frame member and the left frame member of the undercarriage, and mud and debris can collect between those joists. In accordance with this invention, the joists are modified in order to provide a left skid plate 40 and a right skid plate 42 along the underside of the undercarriage 12. Particularly, the joists, which typically extended along the entire width of the undercarriage are, in this embodiment, split joists 44 which extend only along a portion of the width of the load floor, and taper down to the load floor as at 46. In other words, the joists cantilever from their respective frame members. The split joists 44 extend from both the right frame member 16 and the left frame member 18, and are covered by plate metal 48 to box in the split joists 44 and prevent the accumulation of dirt or mud therebetween. As can be seen, the plate metal 48 also extends over the tapered portions 46 of the split joist 44 to taper down the load floor 14 and provide a center channel 50. The center channel 50 is structurally reinforced with crossbeams 52 extending between the left and right skid plates 40, 42.

The left and right skid plates 40, 42, and the load floor 14 are tapered to ensure ease of mobility in rough or muddy areas. As can be seen in FIG. 2, the ground contacting portions of the skid plates 40*a*, 42*a* slope from an edge of an associated frame member 16, 18 toward the load floor 14. The load floor 14 slopes oppositely from an associated frame member 16, 18 to where they join centrally in the center channel 50. The ground contacting portions 40*a*, 42*a* of the skid plates' are joined to the load floor 14 by tapered interconnecting plates 40*b*, 42*b*, as shown. Thus, the left and right skid plates 40, 42 provide tapered flat surfaces 40*a*, 42*a* for supporting the fracture tank 10 as it is pushed over a ground surface, while the channel 50 is defined by tapered surfaces to facilitate the passage of mud and debris. The vast majority of the weight of the fracture tank 10 is supported on the skid plates 40, 42 as a bulldozer or prime mover is employed to move the fracture tank 10 into a desired position.

The wheel box 36 at the rear 22 of the continuous portion of the load floor 14 includes a front box wall 54 extending upwardly from the rear 22, and further includes a top box wall 56 extending rearwardly from the front box wall 54. The top box wall 56 may be considered, as already suggested above, as a continuation of the load floor 14, and, thus, the rear wall 26 of the fracture tank 10 is still properly considered as extending upwardly from the load floor 14.

Figure 3:
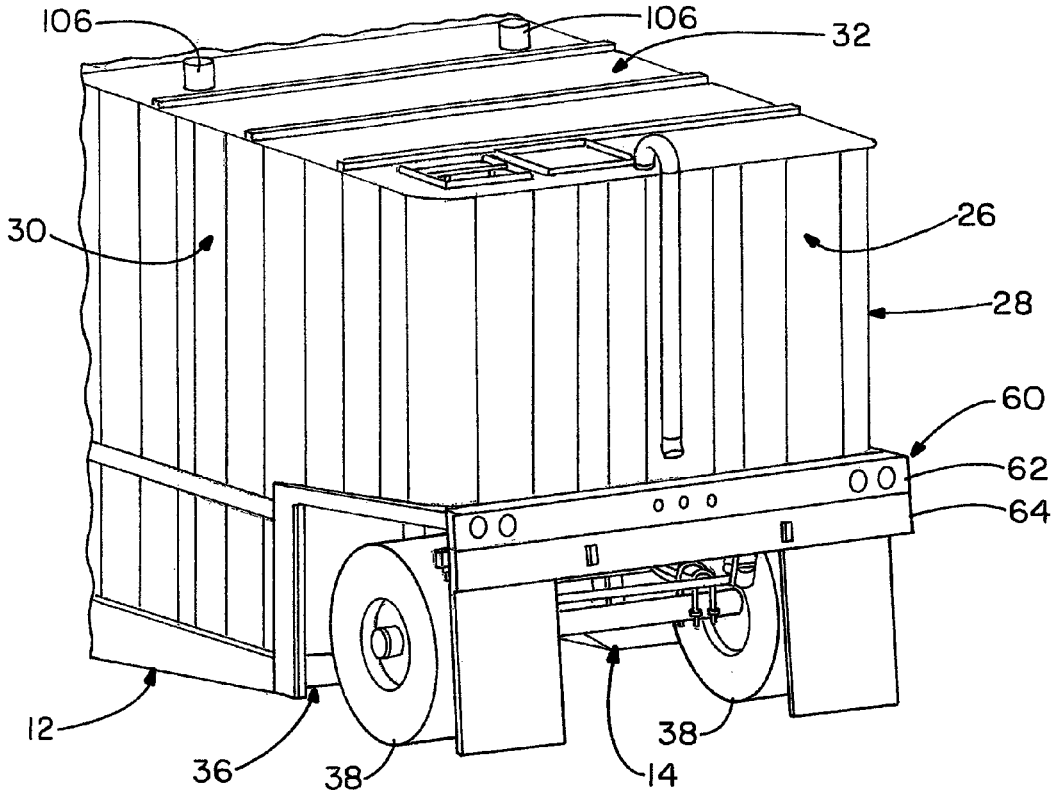
FIG. 3 is a perspective view of the rear of the fracture tank, showing portions of the wheel box and bumper.
Figure 4:
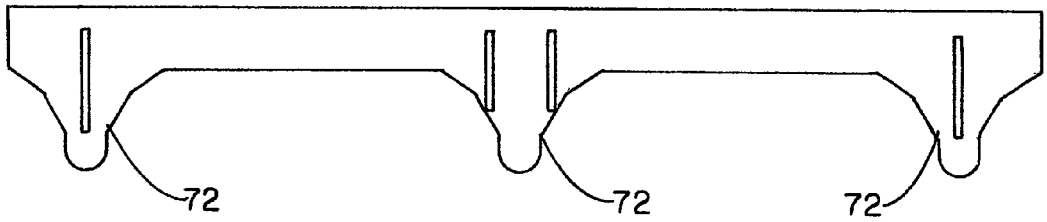
FIG. 4 is a top view of the bumper, showing lift flanges extending from the bumper for engagement by the blade of a bulldozer.
Figure 5:
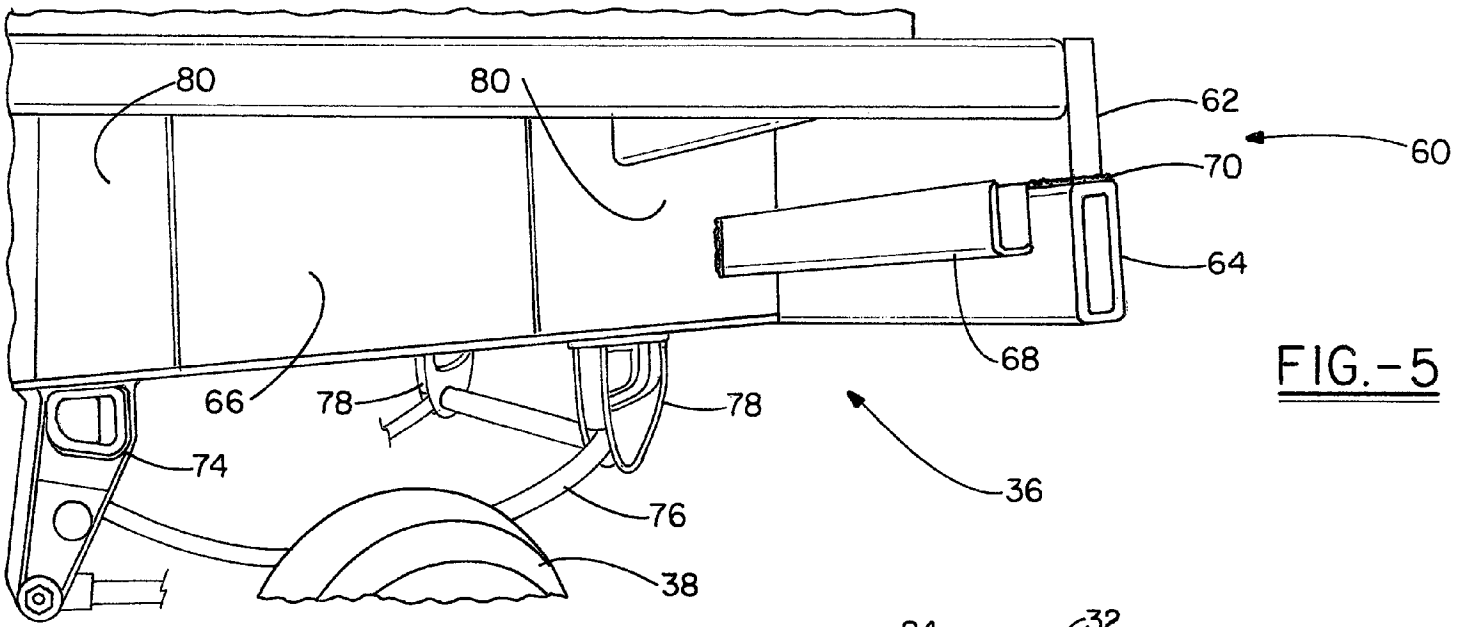
FIG. 5 is a perspective view of the frame members at the wheel box portion of the fracture tank, showing reinforcing elements for the spring hangers and also showing aspects of the bumper.

Referring now to FIGS. 3-5, it can be seen that the fracture tank 10 includes a bumper 60 extending downwardly from the rearward end of the top box wall 56. This bumper 60 includes a common prior art bumper section 62, which houses signal lights and the like, as known. However, as also known, this prior art bumper section 62 is primarily aesthetic and does not have the structural integrity necessary for impact with a blade of a bulldozer, and is often compromised and crushed by contact with the blade during movement of the prior art fracture tanks. Thus, the present invention reinforces the prior art bumper section 62 with a reinforced bumper section 64. The reinforced bumper section 64 can be formed of a suitable structural metal member. Such structural members may include I-beams, angled metal (L-beams), channel beams (C-beams), T-beams and hollow structural sections (also known as structural hollow sections), which may include square, rectangular, circular and elliptical cross sections. In this particular embodiment, the reinforced bumper section 64 is a rectangular cross section hollow structural section that is welded to the prior art bumper section 62.

As seen as in FIG. 5, the reinforced bumper section 64 is further reinforced by being secured to a spring hanger frame member 66 in the wheel box 36 which are preferably connected to frame members or beams 16, 18. More particularly, the reinforced bumper section 64 is secured to two spring hanger frame members 66, one being positioned at the left side of the fracture tank for the left side wheels, and the other being positioned at the right side fracture tank for the right side wheels. Particularly, both the prior art bumper section 62 and the reinforced bumper section 64 are welded to the spring hanger frame members 66. Finally, the reinforced bumper section 64 is further structurally reinforced by a crossbar 68, which extends through the spring hanger frame members 66 (both the right and left side members) and is welded to the reinforced bumper section 64. To further secure the prior art bumper section 62 to the reinforced bumper section 64, the crossbar 68 can be positioned to span between the weld 70 that mates the prior art bumper section 62 to the reinforced bumper section 64. To make the fracture tank 10 more susceptible to movement by a bulldozer, a plurality of blade flanges 72 are integral with and extend from to the reinforced bumper section 64. These blade flanges 72 provide a lip, the underside of which can be engaged with the blade of a bulldozer, and slightly lifted so that the bulldozer receives some of the weight of the fracture tank and is better able to manipulate the fracture tank 10 to position it at a desired location.

When pushing and otherwise maneuvering fracture tanks in muddy regions, a situation can occur where the rear wheels of the fracture tank are buried in mud. If left to sit, the mud can then dry or even freeze in cold weather, encasing the rear wheels and making it difficult to extract them without damaging the area of the fracture tank at the wheel box. Indeed, when a bulldozer engages a fracture tank that has been encased in mud or frozen in fixed position, as just described, it is possible that the force exerted by the bulldozer to remove the wheels from the ice or dried mud can cause the spring hanger frame members to twist or otherwise be structurally warped. This can completely ruin the relationship between the wheels and the remainder of the fracture tank and frame members 16, 18 or 66, making it necessary to replace structurally compromised elements before the fracture tank can then be secured to a tractor for road transport. Thus, with reference to FIG. 5, it can be seen that a front spring hanger 74 extends from the spring hanger frame member 66 to provide a front mounting position for a wheel spring 76, and a rear spring hanger 78 extends from the spring hanger frame member 66 to provide a rear mount position for the wheel spring 76. The area of connection between the front spring hanger 74 and the spring hanger frame member 76 is reinforced with yet another structural metal member, chosen from among those same structural metal members discussed above. Likewise, the area of connection between the rear spring hanger 78 and the spring hanger frame member 66 is also reinforced. The reinforcements can be seen in FIG. 5, identified by the numeral 80. In this particular embodiment, these reinforcements 80 are boxes, enclosing and further strengthening the frame member 66 in the regions immediately above and adjacent the spring hangers 74, 78. By reinforcing the area where the front and rear spring hangers 74, 78 are secured to the spring hanger frame member 66, the likelihood that the spring hanger frame member 66 will be warped by forcefully removing the wheels from a locked frozen or dried mud situation is significantly reduced.

Figure 6:
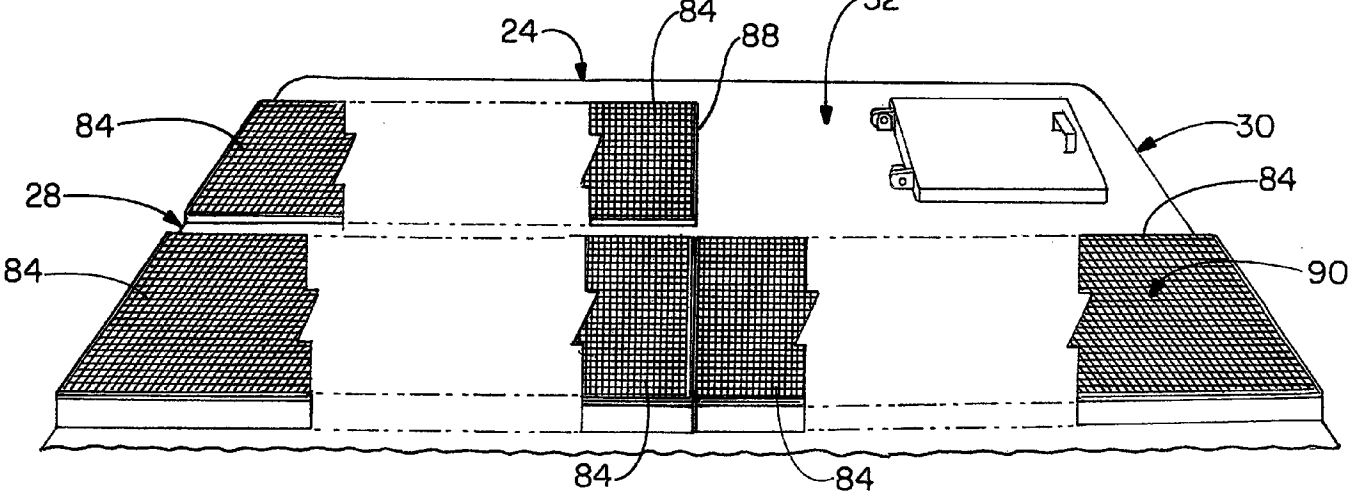
FIG. 6 is a perspective view of the top wall of the fracture tank, showing an anti-slip grid in accordance with an aspect of this invention.

Referring now to FIGS. 1 and 6, additional improvements present in the fracture tank 10 of this invention will be disclosed. It is common for a multitude of fracture tanks to be transported and positioned in the well site area surrounding a bore hole so that the fluid in those fracture tanks will be readily available for use. The workers at the site will try to align multiple fracture tanks side-by-side in order to efficiently utilize space and make it easy for workers to access the fracture tanks when their contents are needed. When a bulldozer is being employed to move the fracture tanks, it is quite difficult to align one fracture tank with another without forcing a fracture tank that is being moved into contact with a stationary fracture tank already in position. Because the fracture tanks are heavy and are being moved with significant force by the bulldozer, the contact between the fracture tanks can serve to damage the walls of the fracture tank. Thus, in accordance with this invention, the right sidewall 28 and the left sidewall 30 each include an alignment bumper 82 extending along their length from the front of the fracture tank 10 to the wheel box 36. The alignment bumper 82 is positioned at the height of the bumper assembly established by the prior art bumper section 62 and the reinforced bumper section 64. A first fracture tank having such an alignment bumper 82 can be pushed forcefully into a second fracture tank having such an alignment bumper without puncturing or otherwise structurally damaging the sidewalls of the fracture tanks. This therefore facilitates the positioning of multiple fracture tanks side-by-side in an aligned relationship.

Once so aligned, the present invention provides structures for making it easy for a worker to access a given fracture tank 10. Particularly, an anti-slip grid 84 is positioned on the exterior of the top wall 32, and is positioned near the front wall 24, where a ladder 86 is provided for ascending to the top wall 32 and onto the anti-slip grid 84. With multiple fracture tanks 10 aligned side-by-side, it will be possible for a worker to walk from one fracture tank 10 to a neighboring fracture tank, using the anti-slip grid 84. As seen in FIG. 6, the anti-slip grid 84 is formed of a multitude of vertically oriented sheet members 88, which are spaced close enough to provide a discontinuous support surface 90 suitable for walking on, and spaced sufficiently apart to provide a volume into which debris and precipitation and other foreign matter can pass. Particularly, in cold and wet climates, precipitation will not collect on the discontinuous support surface 90, but, rather, will fall through the spaces between the vertically oriented sheet members 88. Thus, water will not collect and freeze on the discontinuous support surface 90, and the anti-slip grid 84 will continue to provide, as its name implies, an anti-slip surface. In this particular embodiment, the vertically oriented sheet members 88 are open mesh structures of interconnected diamond shape, as commonly known.

Figure 7:
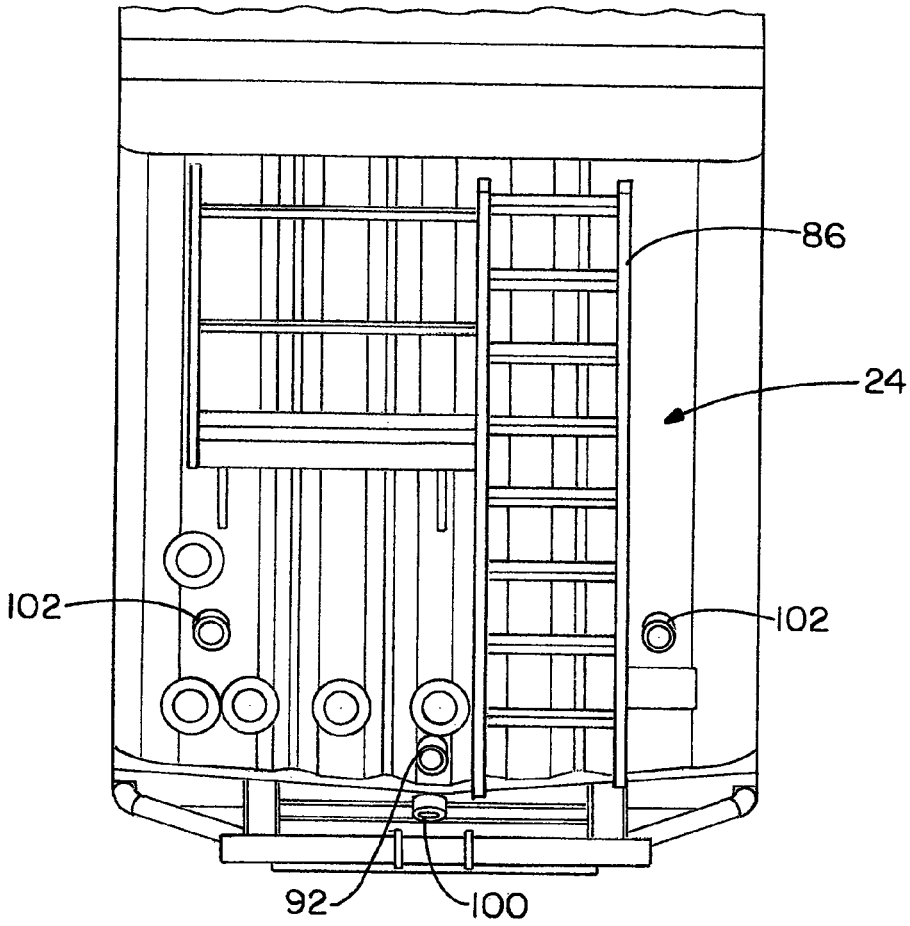
FIG. 7 is a front view of the exterior of the front wall of the fracture tank.
Figure 8:
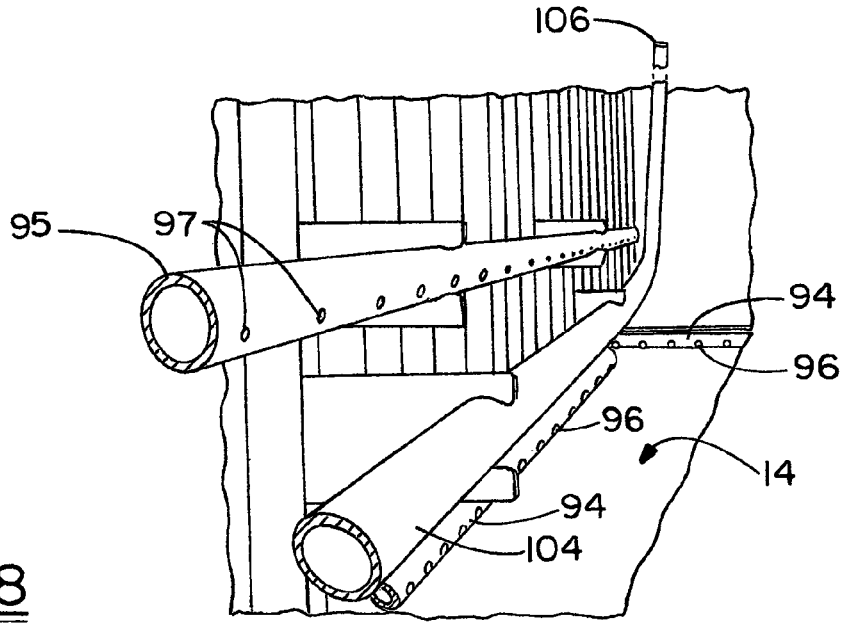
FIG. 8 is a perspective of the inside of the fracture tank, showing a flush pipe and a heat pipe in accordance with this invention.

Referring now to FIGS. 1, 7 and 8 it can be seen that the front wall 24, in addition to providing a ladder 86, also provides multiple ports. A flush type inlet port 92 extends through the front wall 24, and provides an inlet into a flush pipe 94. As seen in FIG. 8, the flush pipe 94 extends along at least a portion of the length of the storage tank 34, and includes a plurality of perforations or slots 96, which are preferably directed toward the load floor 14. The flush pipe 94 enters the tank 34 at 92 and then splits at a "T" joint to run around the base perimeter of the tank and exit together near a corner distant from the entry 92. The distal ends of the split flush pipe 94 are capped with removable caps such that a flushing fluid introduced through the flush pipe inlet port 92 and into the flush pipe 94 can only exit at the perforations or slots 96. By introducing the flushing fluid under a high pressure, multiple jets of flushing fluid are created in the storage tank 34, and are preferably directed at the load floor 14 to clean the same of algae, plant matter and other debris that might exist in the storage tank. The load floor 14, as seen in FIG. 2, can beneficially be tapered (as at 98) to a low point between the left side and right side thereof such that flushing fluid will naturally flow toward the low point. Because the front end of the fracture tank 10 is removed off of the tractor, while the rear end of the fracture tank 10 is supported on wheels, the front end of the fracture tank is typically lowest, and flushing fluid will drain not only toward the centerline created by the taper in the load floor 14 but also toward a drain port 100 extending through the front wall 24. In the event the slots 96 become plugged, the caps at the ends of the pipes 94 may be removed and the pipes 94 may be back-flushed under pressure.

The tank 34 also receives and maintains a gel pipe or pipes 95 along at least a portion of a wall thereof. The gel pipes 95 are characterized by holes or apertures 97 for the introduction of selected chemicals into the tank 34, as is well known in the art.

The front wall 24 may also be provided with heat pipe inlet ports 102, which extend through the front wall 24 to provide inlets into heat pipes 104. The heat pipes 104 extend along at least a portion of the length of the storage tank 34, and then extend through the walls, such as the roof 32, of the storage tank 34 to provide heat pipe outlet ports 106. In this particular embodiment, the heat pipes 104 extend along approximately three-fourths of the length of the storage tank 34 and then bend upwardly to extend through the top wall 32 to provide the heat pipe outlet ports 106. A heated gas can be introduced into the heat pipe inlet port to travel along the length of the heat pipes 104, thereby heating the contents of the storage tank 34 before being expelled at the heat pipe outlet ports 106. This will be particularly beneficial in colder climates where the fracing fluid held in the fracture tank 10 might freeze.

In light of the foregoing, it should be appreciated that the present invention significantly advances the art by providing a fracture tank that is structurally and functionally improved in a number of ways. While particular embodiments of the invention have been disclosed in detail herein, it should be appreciated that the invention is not limited thereto or thereby inasmuch as variations on the invention herein will be readily appreciated by those of ordinary skill in the art. The scope of the invention shall be appreciated from the claims that follow.

What is claimed is:

1. A fracture tank comprising:

an undercarriage, said undercarriage comprising:

a load floor having a right side and a left side defining a width of the load floor, and a front and rear defining a length of said load floor, a right frame member extending along the length of said load floor to provide structural support for the undercarriage, a left frame member extending along the length of said load floor to provide structural support for the undercarriage, a right skid plate extending from said right frame member along at least a portion of the width of the load floor, a left skid plate extending from said left frame member along at least a portion of the width of the load floor, said right and left skid plates providing flat surfaces that contact a ground surface to support the tank as it is pushed over the ground surface while resting on said right and left skid plates, wherein said right skid plate is formed of a plurality of split joists extending from said right frame member along a portion of the width of the load floor and tapering to the load floor, said split joists being covered by plate metal to box in said split joists and prevent the accumulation of dirt or mud between said split joists, and wherein said left skid plate is formed of a plurality of split joists extending from said left frame member along a portion of the width of the load floor and tapering to the load floor, said split joists being covered by plate metal to box in said split joists and prevent the accumulation of dirt or mud between said split joists.

2. The fracture tank of claim 1, wherein said right skid plate and said left skid plate taper to the load floor to provide a center channel, and the load floor at said center channel is structurally reinforced with cross beams extending between said right and left skid plates.

3. The fracture tank of claim 2, wherein said flat surfaces of said skid plates for supporting the tank are tapered from said respective frame members toward said load floor.

4. The fracture tank of claim 1, further comprising:

a drain port extending though one of said walls to drain flush fluid and debris from said storage tank.

5. The fracture tank of claim 4, wherein said load floor is tapered to a low point between said left side and said right side thereof such that flush fluid naturally flows toward said low point, said low point extending to said drain port to further facilitate draining of flush fluid and debris.

6. The fracture tank of claim 1, further comprising a wheel box at the rear of said load floor, said wheel box including a front box wall extending upwardly from said rear of said load floor, and a top box wall extending rearwardly from said front box wall.

7. The fracture tank of claim 6, further comprising:

a spring hanger frame member positioned in said wheel box;

a first spring hanger extending from said spring hanger frame member;

a second spring hanger extending from said spring hanger frame member;

a spring member extending between said first and second spring hangers, wherein said spring hanger frame member is reinforced at the position at which said first spring hanger extends from said spring hanger frame member, and is also reinforced at the position at which said second spring hanger extends from said spring hanger frame member.

8. The fracture tank of claim 7, wherein said spring hanger frame member is reinforced by a structural steel member.

9. The fracture tank of claim 8, wherein said structural steel member is selected from the group consisting of I-beams, L-beams, C-beams, T-beams, and hollow structural sections.

10. The fracture tank of claim 9, wherein said spring hanger frame member is selected from the group consisting of I-beams and C-beams, and said I-beam is reinforced at said front and rear spring hanger support members by a structural member selected from the group consisting of C-beams and hollow structural sections.

11. The fracture tank of claim 6, further comprising:

a bumper extending downwardly from said top box wall, said bumper being formed of at least one hollow structural section; and a box frame structure for said wheel box, said bumper being fixed to and integral with said box frame, said bumper having integral engagement flanges extending therefrom.

12. The fracture tank of claim 1, further comprising:

an alignment bumper extending along the length of said left sidewall; and an alignment bumper extending along the length of said right sidewall, such that a first fracture tank having said alignment bumpers can be pushed forcefully into a second fracture tank having said alignment bumpers without puncturing or otherwise structurally damaging the sidewalls of the fracture tanks, thus facilitating the positioning of first and second fracture tanks side-by-side in an aligned relationship.

13. The fracture tank of claim 12 further comprising an anti-slip grid positioned on the exterior of the top wall, said anti-slip grid being formed of vertically oriented sheet members spaced apart to provide volume into which debris and precipitation and other foreign matter can pass, and spaced close enough to provide a discontinuous support surface suitable for walking on.

14. The fracture tank of claim 13, wherein said anti-slip grid is positioned near the front wall, and a ladder is provided at the front wall for ascending to the top wall and onto the anti-slip grid.

* * * * *